US005409440A

United States Patent [19]

Yang

[11] Patent Number: 5,409,440

[45] Date of Patent: Apr. 25, 1995

[54] EXERCISE MECHANISM HAVING MULTIPLE FUNCTIONS

[76] Inventor: Huo-Sheng Yang, 58, Ma Yuan West St., Taichung, Taiwan, Prov. of China

[21] Appl. No.: 187,766

[22] Filed: Jan. 28, 1994

[51] Int. Cl.[6] ..... A63B 21/06

[52] U.S. Cl. ..... 482/138; 482/97; 482/98; 482/101

[58] Field of Search ..... 482/138, 97, 98, 99, 482/100, 101, 137, 133, 135, 136

[56] References Cited

U.S. PATENT DOCUMENTS 4,456,246 6/1984 Szabo ..... 482/98
4,511,137 4/1985 Jones ..... 482/100
4,842,270 6/1989 Lange ..... 482/101
5,217,422 6/1993 Domzalski ..... 482/138

*Primary Examiner*—Richard J. Apley
*Assistant Examiner*—Lynne A. Reichard

[57] ABSTRACT

An exercise mechanism includes a base, a post and a pole extended upward from the base, a sleeve slidably engaged on the pole, a weight secured to the sleeve, a bracket pivotally secured to the post, and a cable coupling the bracket to the sleeve for lifting the sleeve and the weight upward when the bracket is rotated, a curved track fixed in the bracket, a frame pivotally secured to the post and having one end engaging with the curved track. The exercise mechanism can be used for practicing various kinds of exercises.

3 Claims, 12 Drawing Sheets

EXERCISE MECHANISM HAVING MULTIPLE FUNCTIONS

BACKGROUND OF THE INVENTION

1. Field of the Invention

The present invention relates to an exercise mechanism, and more particularly to an exercise mechanism having multiple functions.

2. Description of the Prior Art

Various kinds of exercise mechanisms have been developed and widely used, for example, as shown in FIG. 11, illustrated is an exercise mechanism for training the lower group of muscles, and the exercise mechanisms as shown in FIGS. 12 to 15 are provided for training the upper group of muscles. However, each of the exercise mechanisms can be provided for doing only one type of exercise.

The present invention has arisen to mitigate and/or obviate the afore-described disadvantages of the conventional exercise mechanisms.

SUMMARY OF THE INVENTION

The primary objective of the present invention is to provide an exercise mechanism which can be used for executing various kinds of exercises.

In accordance with one aspect of the invention, there is provided an exercise mechanism comprising a base; post means and pole means extended upward from the base and extended in parallel with each other; a sleeve slidably engaged on the pole means; weight materials secured to the sleeve; a bracket including an upper end pivotally secured to the post means and including a lower end; and cable means coupling the lower end of the bracket to the sleeve for lifting the sleeve and the weight materials upward along the pole means when the bracket is rotated about the upper end thereof.

A pair of foot pedals are secured to the lower end of the bracket for rotating the bracket against gravity force of the weight materials, and a handle assembly is secured to the upper end of the bracket for rotating the bracket against gravity force of the weight materials.

A curved track is fixed in the bracket, a frame is pivotally secured to the post means and includes one end rotatably engaging with the curved track, and a handle means is secured to the frame for rotating the frame relative to the bracket.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
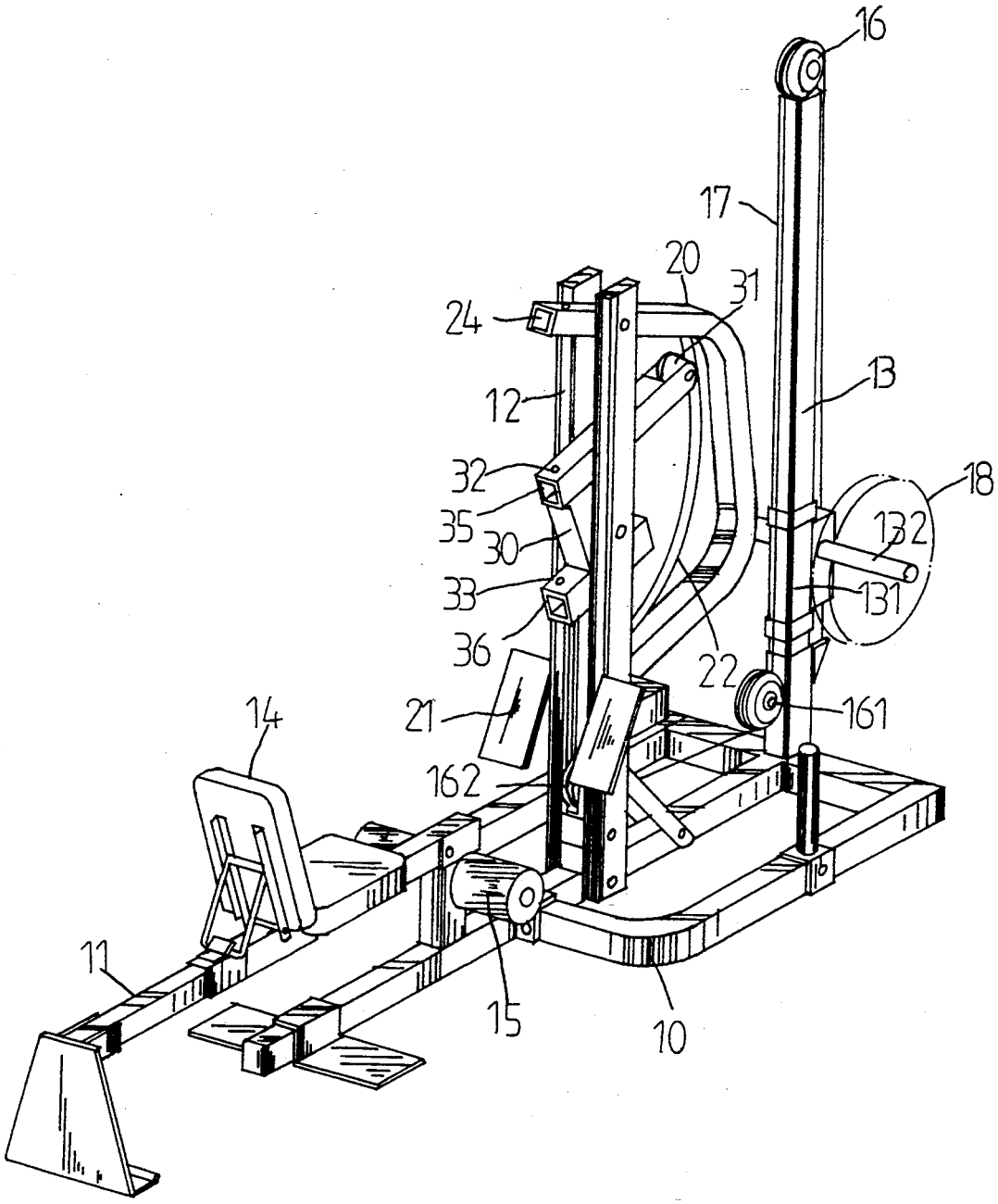
FIG. 1 is a perspective view of an exercise mechanism in accordance with the present invention.
Figure 2:
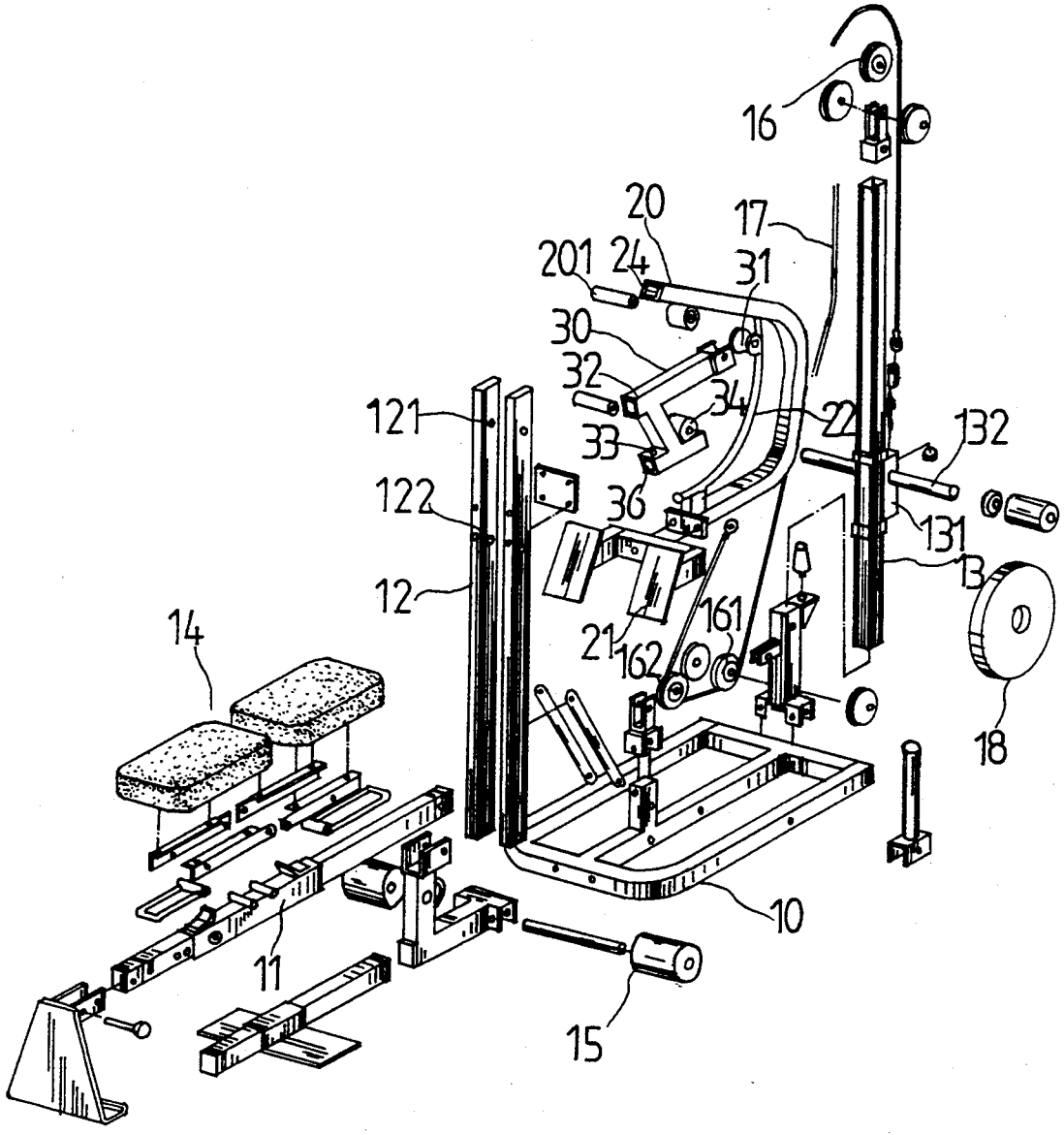
FIG. 2 is an exploded view of the exercise mechanism.
Figure 4:
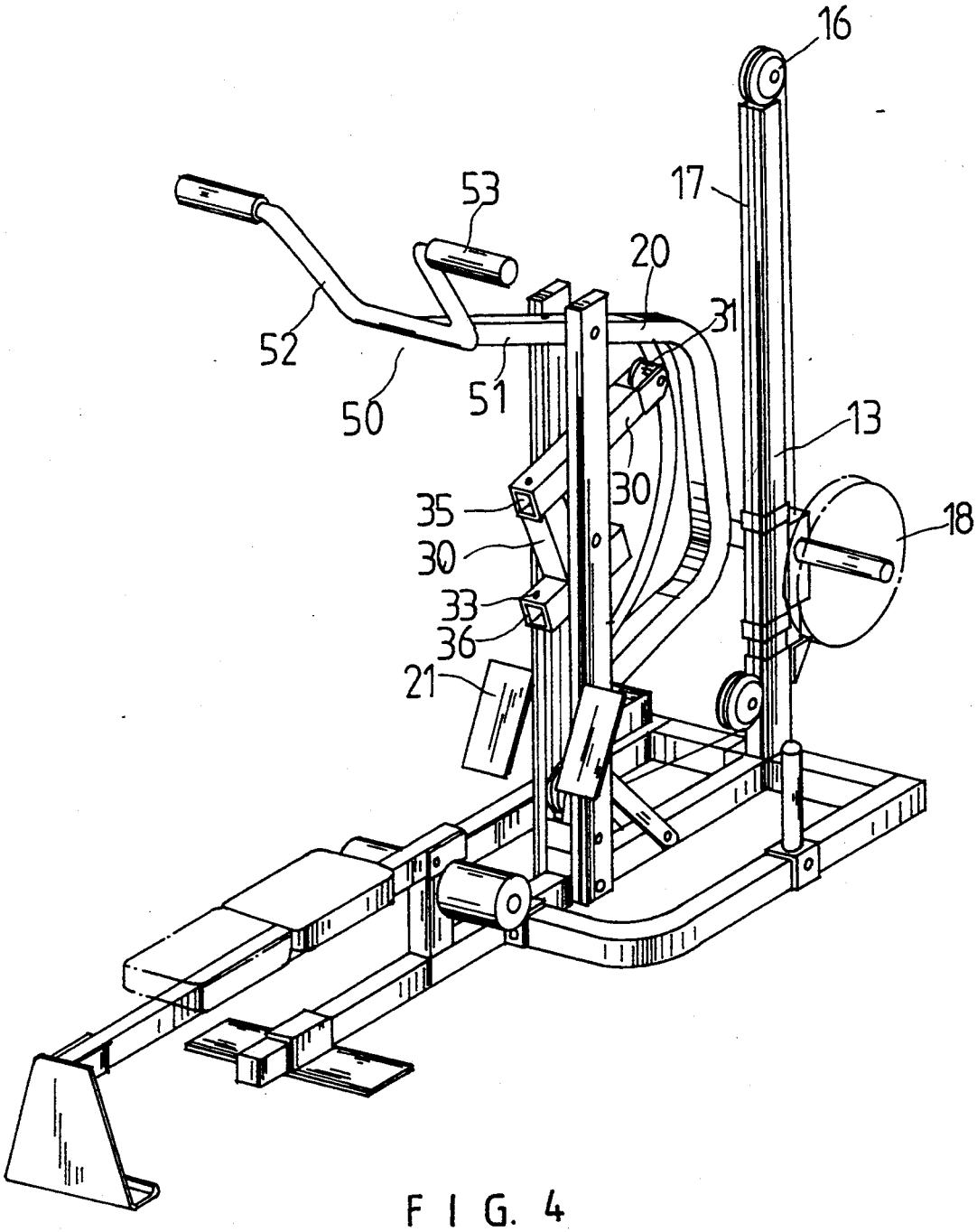
Figure 9:
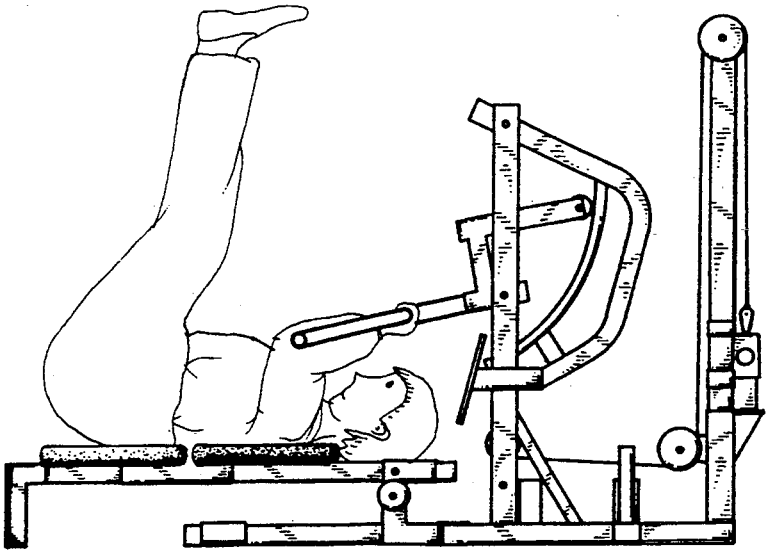

Referring to the drawings, and initially to FIGS. 1 and 2, an exercise mechanism in accordance with the present invention comprises a base 10, a beam 11 horizontally disposed above the base 10, a seat 14 disposed on the beam 11 and including a back support which can be lay down to a horizontal position until the back support and the seat cushion form a flat support (FIGS. 4 and 9). A pair of rollers 15 are rotatably secured to one end portion of the beam 11 for hooking the feet of the users. A pair of posts 12 are extended upward in parallel in the middle portion of the base 10 and each includes two holes 121, 122 formed in the upper portion thereof. A pole 13 is extended upward from the base 10 and extended in parallel with the posts 12. A sleeve 131 is slidably engaged on the pole 13 and includes two extensions 132 extended outward for supporting weight materials 18. A pulley 16 is rotatably supported on top of the pole 13, a pulley 161 is rotatably secured to the bottom portion of the pole 13, and another pulley 162 is rotatably supported in the bottom portion of the post 12. A cable 17 is engaged over the pulleys 16, 161, 162 and includes one end fixed to the sleeve 131.

Figure 10:
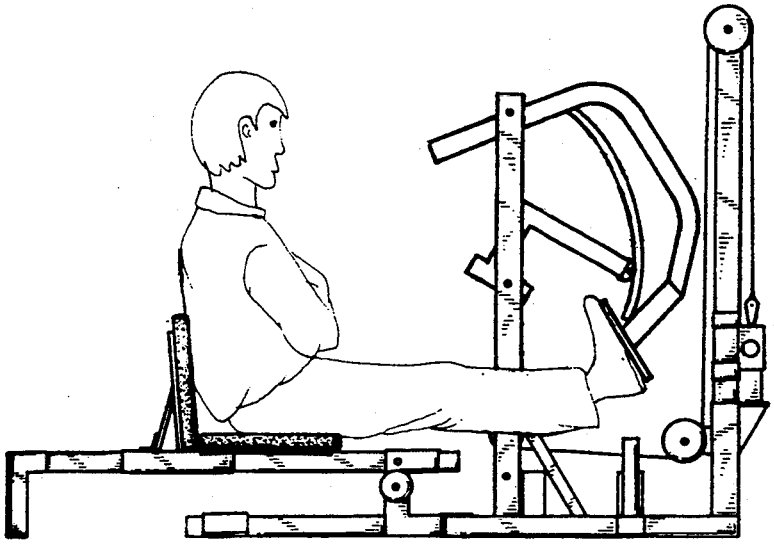
Figure 11:
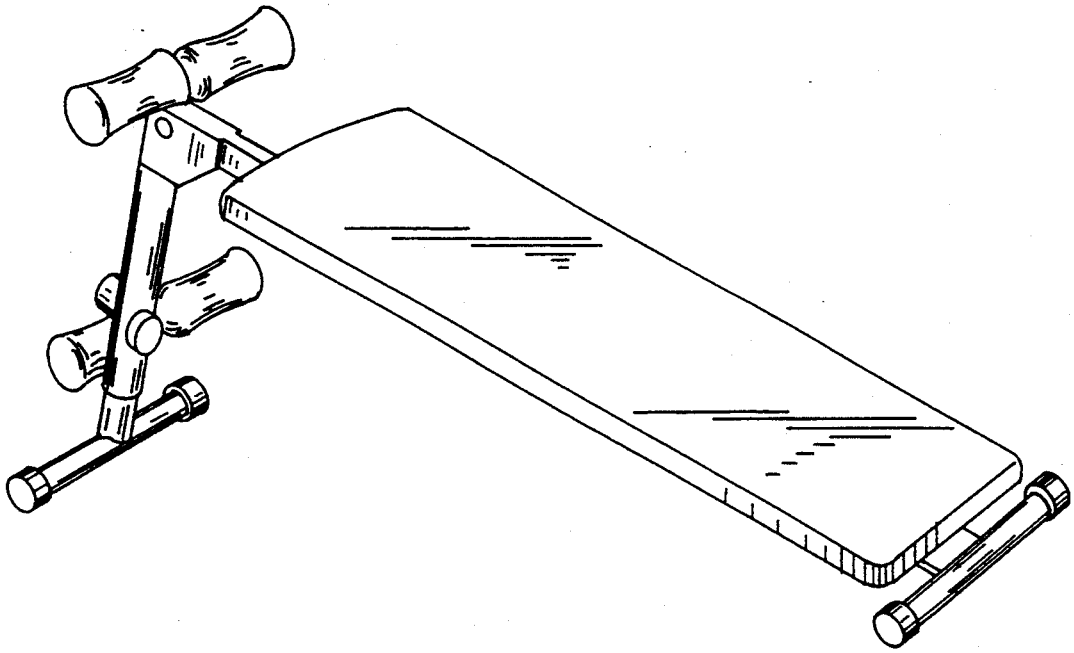
F I G. 11 PRIOR ART
FIGS. 11, 12, 13, 14 and 15 are perspective views illustrating five typical exercise mechanisms.
Figure 12:
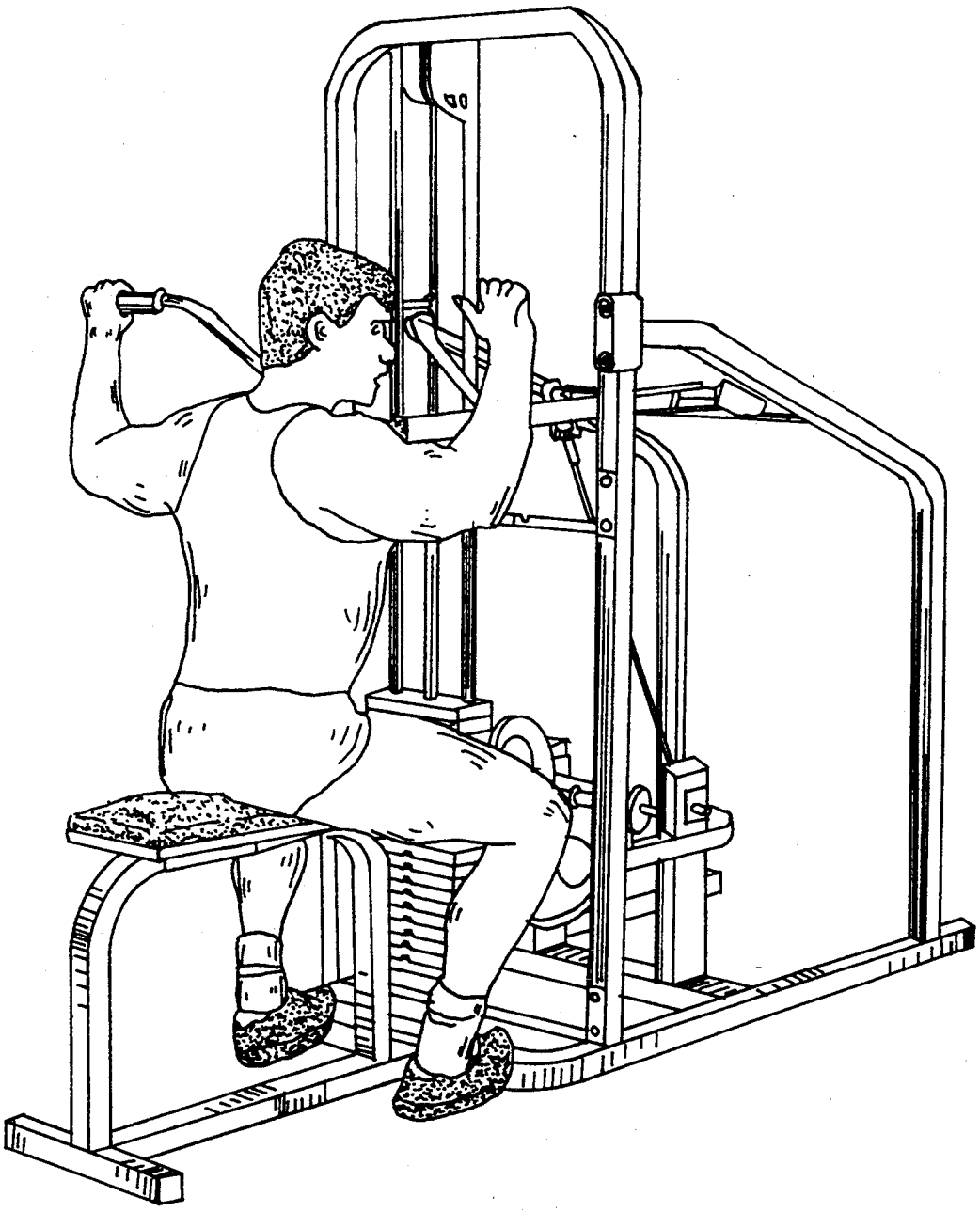
F I G. 12 PRIOR ART
Figure 13:
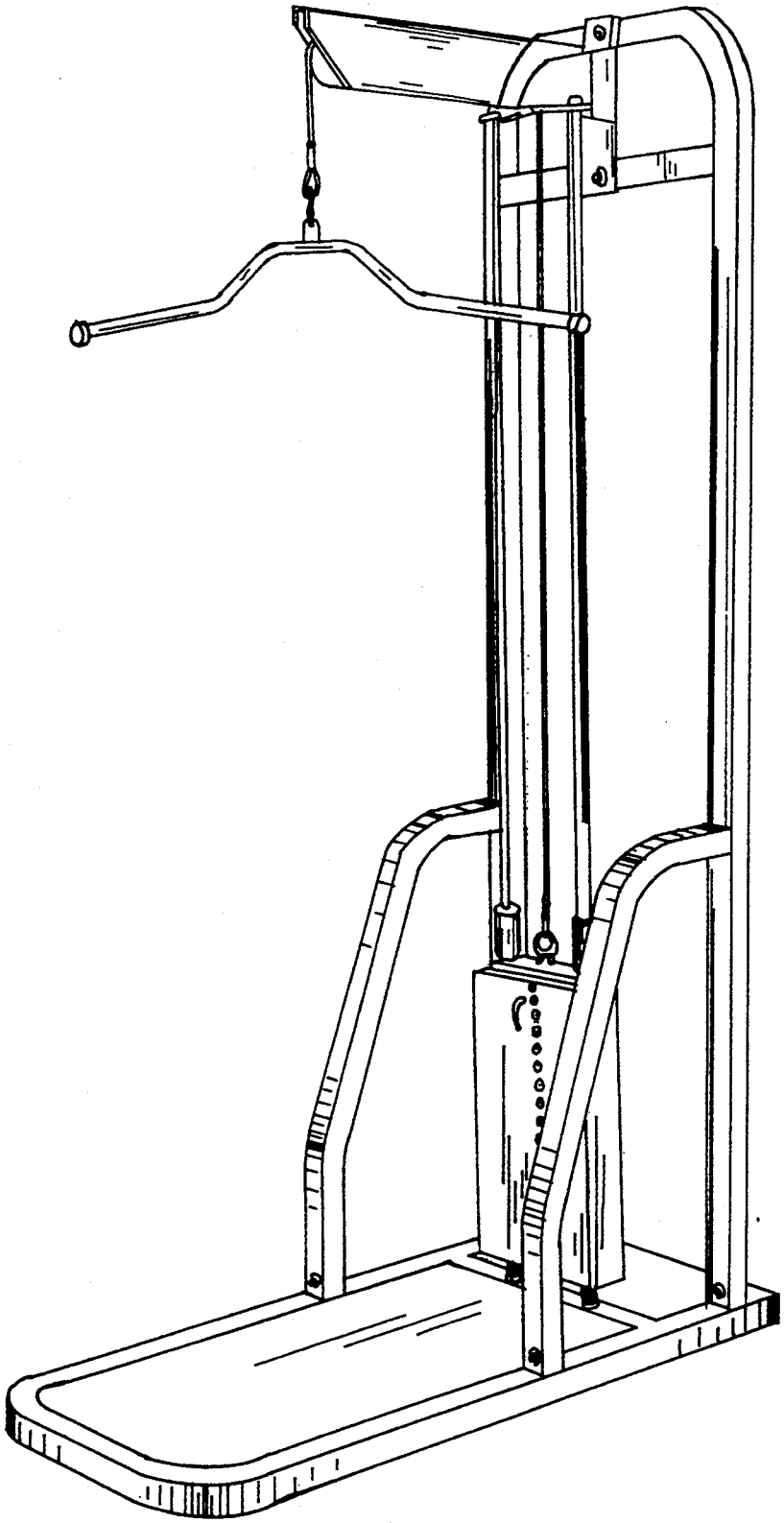
F I G. 13 PRIOR ART
Figure 14:
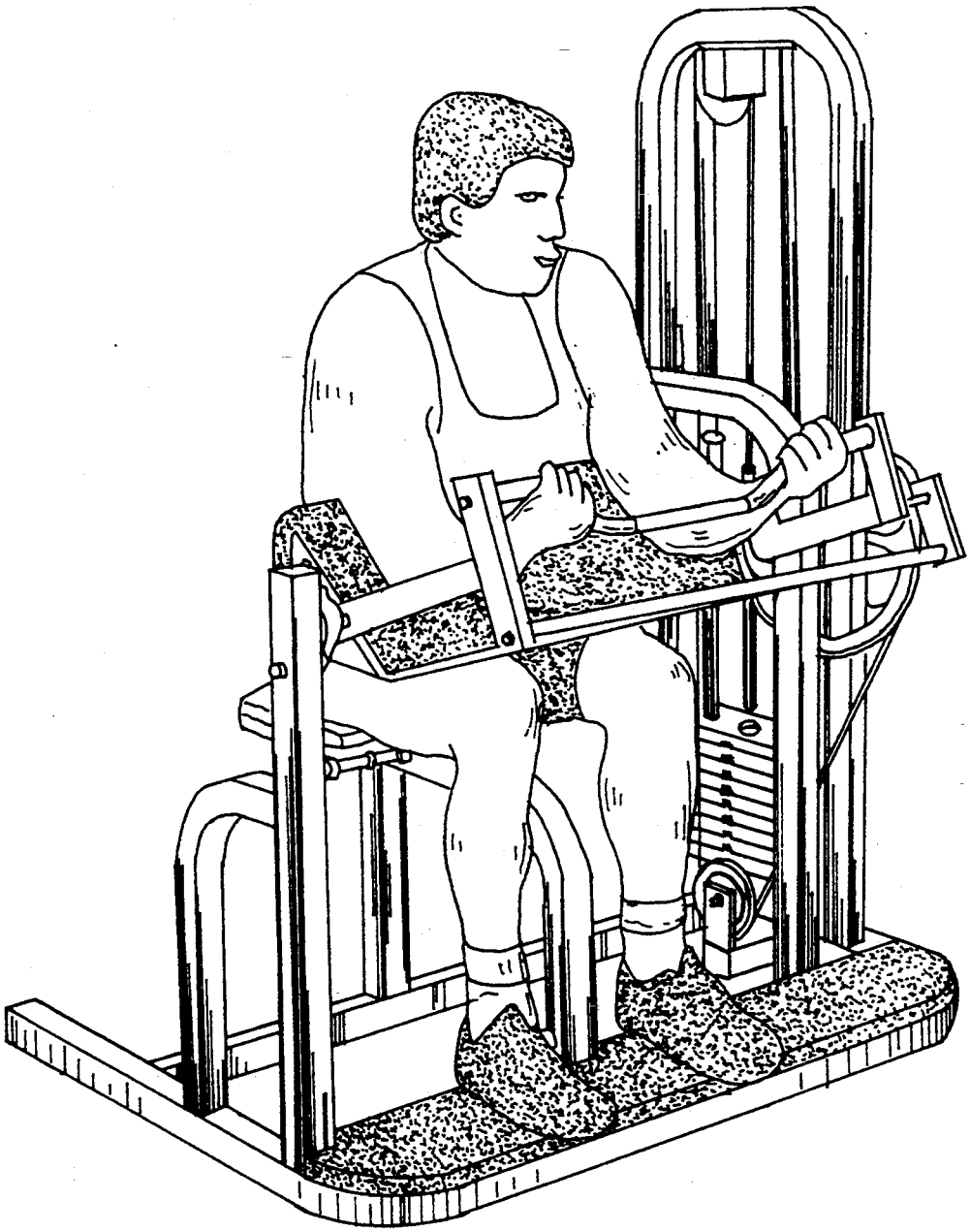
F I G. 14 PRIOR ART
Figure 15:
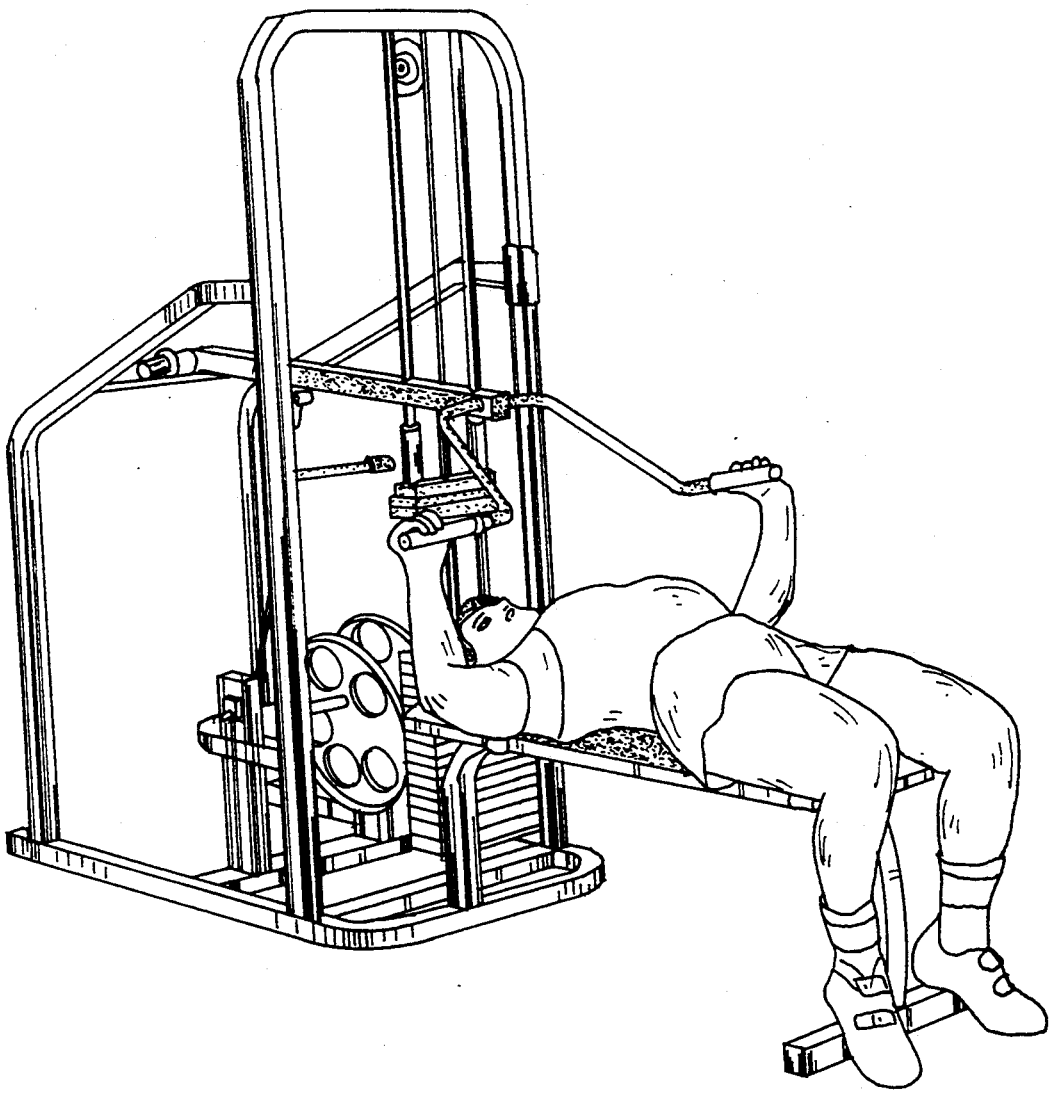
F I G. 15 PRIOR ART

A C-shaped bracket 20 includes an upper end pivotally supported in the upper end of the posts 12 by a pin 201 which is engaged in the holes 121, and a lower end connected to the other end of the cable 17. When the lower end of the bracket 20 is moved, it has to overcome the weight of the weight materials 18. A pair of foot pedals 21 are fixed to the lower end of the bracket 20 such that the users may step on the foot pedals 21 in order to train the lower group of muscle (FIG. 10). A curved track 22 is fixed in the bracket 20. A frame 30 includes a hub 34 pivotally supported between the posts 12 by a pin element which is engaged in the holes 122 of the posts 12, a roller 31 secured to the frame 30 and rotatably engaged with the track 22, and two apertures 32, 33 formed in the frame 30.

Figure 3:
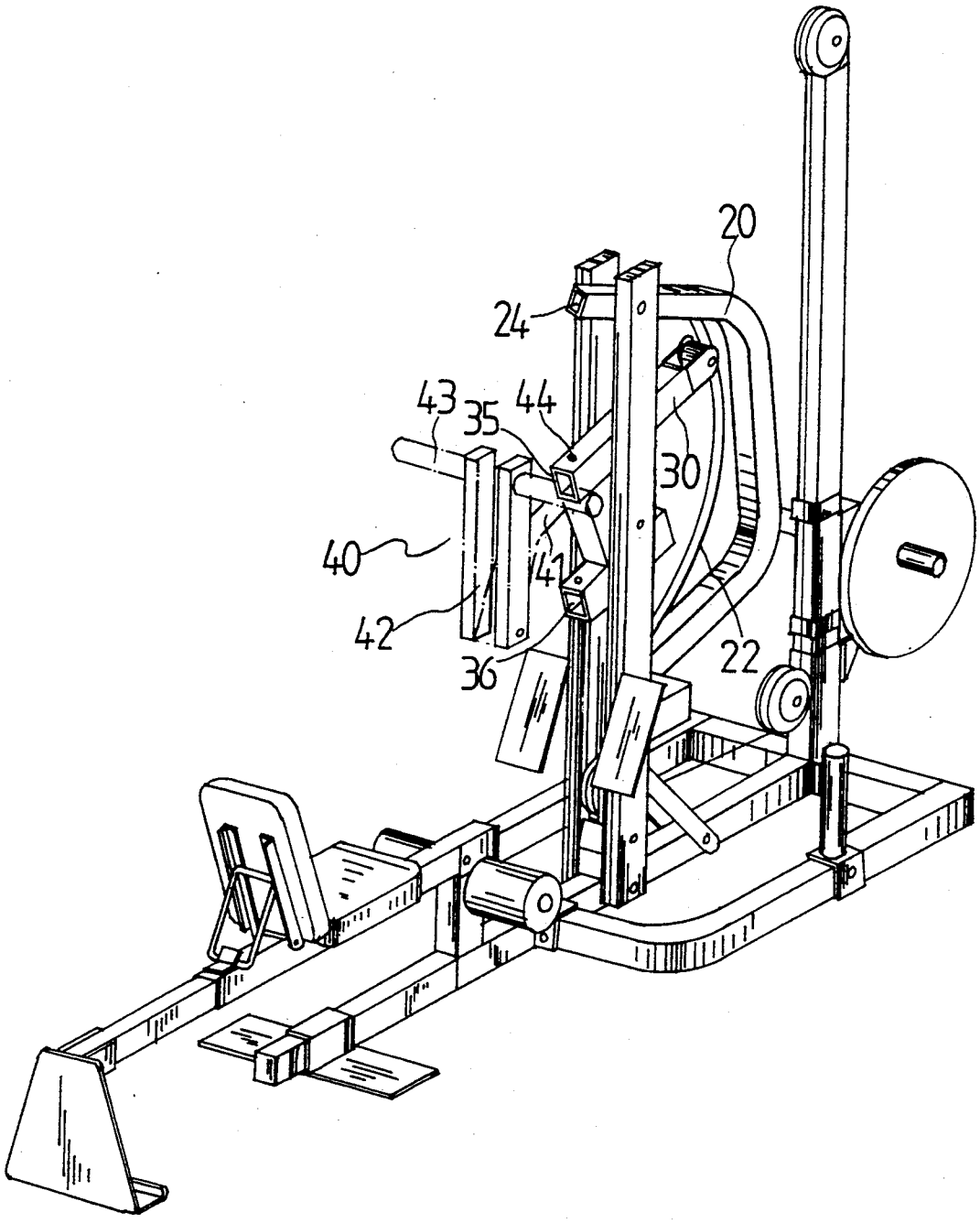
FIGS. 3 and 4 are perspective views illustrating two applications of the exercise mechanism.
Figure 5:
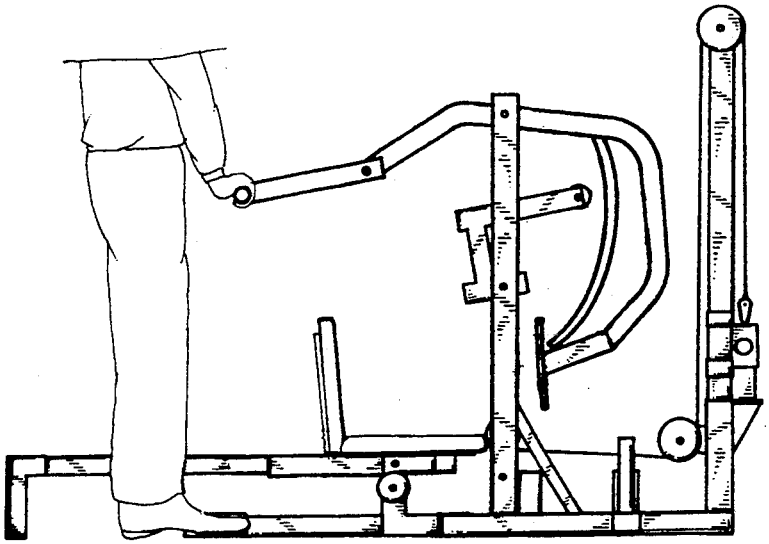
FIGS. 5, 6, 7, 8, 9 and 10 are schematic views illustrating the operation of the exercise mechanism.
Figure 6:
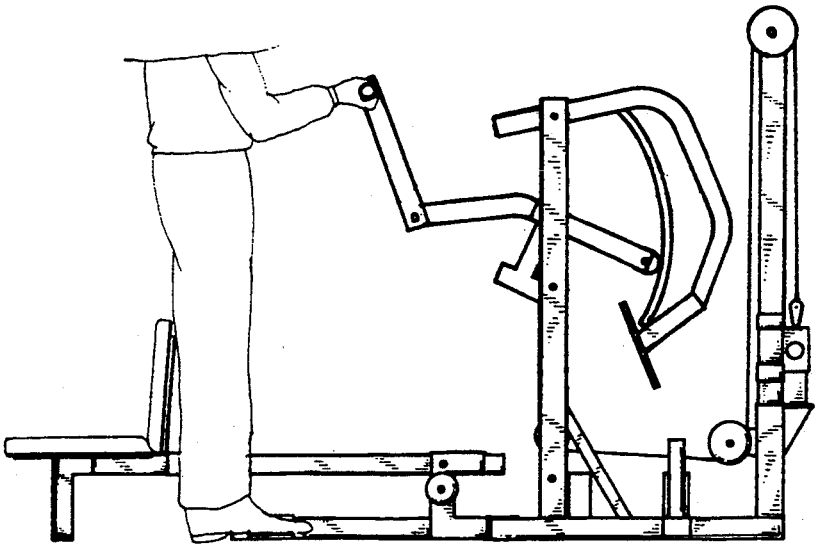
Figure 7:
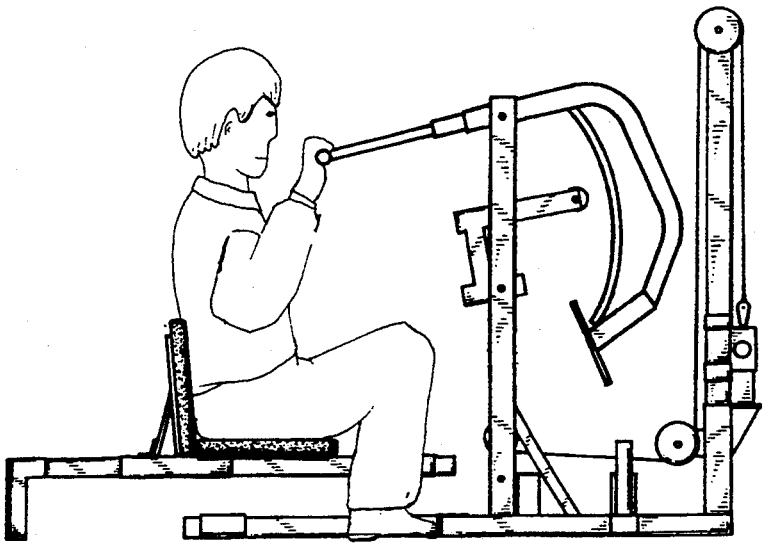
Figure 8:
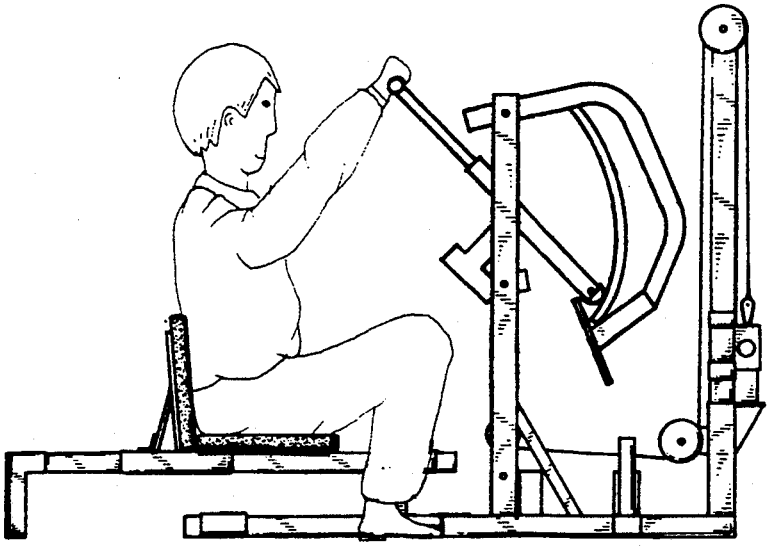

Referring next to FIG. 3, a handle assembly 40 includes a bar 41 engaged in one of two openings 35, 36 formed in the frame 30 and fixed in place by pin element 44, two clubs 42 having one end pivotally coupled to the bar 41 and having a handle 43 laterally secured to the other end, such that the users may use the handle assembly 40 to practice the upper group of muscles (FIG. 6). The handle assembly 40 may also be secured to the other opening 36 or secured to another opening 24 formed in the upper end of the bracket 20 (FIG. 5) so as to train the upper group of muscles.

Referring next to FIG. 4, another type of handle assembly 50 may include a bar 51 for engaging with either of the openings 24, 35, 36 (FIGS. 4, 7, 8, 9) so as to practice other types of exercises.

Accordingly, the exercise mechanism in accordance with the present invention can be used to practice various kinds of exercises and to train various groups of muscles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise mechanism comprising:

a base;

post means and pole means extended upward from said base and extended in parallel with each other;

a sleeve slidably engaged on said pole means;

weight materials secured to said sleeve;

a bracket including an upper end pivotally secured to said post means and including a lower end;

a curved track fixed in said bracket, a frame pivotally secured to said post means and including one end rotatably engaging with said curved track, and a handle means secured to said frame for rotating said frame; and cable means coupling said lower end of said bracket to said sleeve for lifting said sleeve and said weight materials upward along said pole means when said bracket is rotated about said upper end thereof.

2. An exercise mechanism according to claim 1 further comprising a pair of foot pedals secured to said lower end of said bracket for rotating said bracket against gravity force of said weight materials.

3. An exercise mechanism according to claim 1 further comprising a handle assembly secured to said upper end of said bracket for rotating said bracket against gravity force of said weight materials.

* * * * *